US010570526B2

(12) United States Patent
McHugh et al.

(10) Patent No.: US 10,570,526 B2
(45) Date of Patent: Feb. 25, 2020

(54) ELECTROPLATING WAFERS HAVING A PATTERN INDUCED NON-UNIFORMITY

(71) Applicant: APPLIED Materials, Inc., Santa Clara, CA (US)

(72) Inventors: Paul R. McHugh, Kalispell, MT (US); Gregory J. Wilson, Kalispell, MT (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 197 days.

(21) Appl. No.: 15/630,055

(22) Filed: Jun. 22, 2017

(65) Prior Publication Data

US 2017/0283976 A1 Oct. 5, 2017

Related U.S. Application Data

(63) Continuation of application No. 14/686,537, filed on Apr. 14, 2015, now Pat. No. 9,689,082.

(51) Int. Cl.

| | |
|---|---|
| ***C25B 9/06*** | (2006.01) |
| ***C25B 9/02*** | (2006.01) |
| ***C25B 15/00*** | (2006.01) |
| ***C25B 9/12*** | (2006.01) |
| ***C25B 9/18*** | (2006.01) |
| ***C25D 17/00*** | (2006.01) |
| *C25D 7/12* | (2006.01) |

(52) U.S. Cl.

CPC ..... *C25D 17/001* (2013.01); *C25D 17/005* (2013.01); *C25D 17/008* (2013.01); *C25D 7/123* (2013.01)

(58) Field of Classification Search

CPC .... C25B 9/06; C25B 9/00; C25B 9/02; C25B 15/00; C25B 9/12; C25B 9/18

USPC ..... 204/242

See application file for complete search history.

(56) References Cited

U.S. PATENT DOCUMENTS

| | | | |
|---|---|---|---|
| 5,227,041 | A | 7/1993 | Brogden |
| 5,761,023 | A | 6/1998 | Lue et al. |
| 6,004,440 | A | 12/1999 | Hanson et al. |
| 6,027,631 | A | 2/2000 | Broadbent |
| 6,174,425 | B1 | 1/2001 | Simpson |
| 6,551,483 | B1 | 4/2003 | Mayer |
| 6,645,356 | B1 | 11/2003 | Woodruff |
| 7,985,325 | B2 | 7/2011 | Rash et al. |
| 2002/0125140 | A1 | 12/2002 | Uzoh |
| 2002/0195352 | A1 | 12/2002 | Mayer |
| 2003/0079995 | A1 | 5/2003 | Contolini |
| 2003/0168345 | A1 | 9/2003 | Tsai |
| 2004/0000485 | A1 | 1/2004 | Preusse et al. |

(Continued)

*Primary Examiner* — Zulmariam Mendez

(74) *Attorney, Agent, or Firm* — Perkins Coie LLP; Kenneth H. Ohriner

(57) ABSTRACT

An electroplating apparatus has a vessel for holding electrolyte. A head has a rotor including a contact ring for holding a wafer having a notch. The contact ring includes a perimeter voltage ring having perimeter contact fingers for contacting the wafer around the perimeter of the wafer, except at the notch. The contact ring also has a notch contact segment having one or more notch contact fingers for contacting the wafer at the notch. The perimeter voltage ring is insulated from the notch contact segment. A negative voltage source is connected to the perimeter voltage ring, and a positive voltage source connected to the notch contact segment. The positive voltage applied at the notch reduces the current crowding effect at the notch. The wafer is plated with a film having more uniform thickness.

18 Claims, 9 Drawing Sheets

(56) References Cited

U.S. PATENT DOCUMENTS

| | | | |
|---|---|---|---|
| 2009/0107836 | A1 | 4/2009 | Rash et al. |
| 2010/0122908 | A1 | 5/2010 | Takeguchi |
| 2011/0308955 | A1 | 12/2011 | Olson |
| 2012/0258408 | A1 | 10/2012 | Mayer |
| 2013/0062197 | A1 | 3/2013 | He et al. |
| 2013/0146447 | A1 | 6/2013 | Wilson |
| 2013/0306465 | A1 | 11/2013 | Zimmerman et al. |
| 2016/0215409 | A1 | 7/2016 | Wilson |

ELECTROPLATING WAFERS HAVING A PATTERN INDUCED NON-UNIFORMITY

PRIORITY CLAIM

This application is a Continuation of U.S. patent application Ser. No. 14/686,537, filed Apr. 14, 2015, and now pending.

BACKGROUND OF THE INVENTION

Manufacture of semiconductor integrated circuits and other micro-scale devices typically requires formation of multiple metal layers on a wafer or other substrate. By electroplating metals layers in combination with other steps, such as planarizing, etching and photolithography, patterned metal layers forming the micro-scale devices are created.

Electroplating is performed with the wafer, or one side of the substrate, in a bath of liquid electrolyte, and with electrical contacts on a contact ring touching a conductive layer on the wafer surface. Electrical current is passed through the electrolyte and the conductive layer. Metal ions in the electrolyte deposit or plate out onto the wafer, creating a metal film on the wafer. The metal ions also tend to plate out onto the electrical contacts as well, which changes the electric field around the contacts, causing non-uniform plating. The metal plated onto the electrical contacts consequently must be removed, adding to the time requirements and complexity of the manufacturing process.

To avoid having metal ions plate out onto the electrical contacts, contact rings have been designed with a seal that seals the electrolyte away from the electrical contacts. The seal rests on the wafer surface radially inwardly of the electrical contacts, keeping the electrolyte away from the electrical contacts. Industry specifications for plating with a sealed contact ring increasingly require that the annular band at the edge of the wafer covered by the seal be as small as possible, currently towards about 1 mm. Some wafers have a notch in the edge of the wafer to indicate a specific crystal orientation of the wafer material. To plate a wafer having a notch, the seal of the contact ring must have an inward protrusion at the notch. During electroplating, electric current is concentrated at the notch due to the irregular geometry. This causes the plated film to be thicker around the notch than on the rest of the wafer. The yield of the wafer may therefore be reduced since the thicker plated film around the notch may negatively affect subsequent processing steps.

Accordingly, engineering challenges remain in electroplating wafers and similar work pieces having a notch or other edge irregularities.

SUMMARY OF THE INVENTION

Current crowding resulting in thicker plating in the region of the notch is reduced or eliminated by a local positive voltage applied to the region of the notch. In a first aspect, an electroplating apparatus has a vessel for holding electrolyte with one or more anodes in the vessel. A head has a rotor including a contact ring for holding a wafer having a notch. The contact ring includes a perimeter voltage ring having perimeter contact fingers for contacting the wafer around the perimeter of the wafer. The contact ring also has a notch contact segment having one or more notch contact fingers for contacting the wafer at the notch. The perimeter voltage ring is insulated from the notch contact segment. A seal on the contact ring seals the perimeter contact fingers and the notch contact fingers from the electrolyte. A negative voltage source is connected to the perimeter voltage ring, or the perimeter voltage ring is electrically grounded, and a relatively positive voltage source connected to the notch contact segment. The positive voltage applied at the notch reduces the current crowding effect at the notch. The wafer is plated with a film having more uniform thickness.

DETAILED DESCRIPTION

Figure 5:
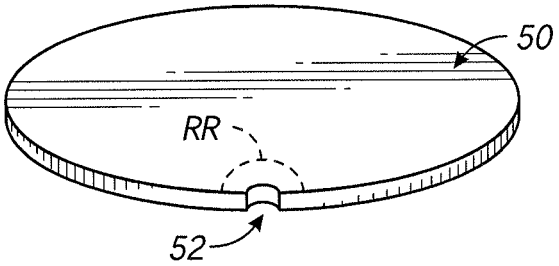
FIG. 5 PRIOR ART
FIG. 5 is a perspective schematic view of the wafer shown in FIG. 4.

To achieve a high yield of devices from each wafer, the edge zone which is contacted by the seal must be as small as possible. In the past, an edge zone of 2 or 3 mm (i.e., the annular ring at the wafer edge not useable for manufacturing devices) was often acceptable. With current industry requirements, the edge zone is now approaching or already at 1 mm. Referring momentarily to FIG. 5, some wafers 50 have a notch 52 (enlarged for illustration). On a 300 mm diameter wafer 50, the notch 52 extends in 1.5 mm. Therefore, the seal used for processing these types of wafers has an inward projection at the notch to avoid plating fluid leaking through the notch. The resulting seal covers more of the wafer around the notch. This changes the electric field in the region around the notch, causing the plated film around the notch to be thicker than the plated film on the rest of the wafer, due to current crowding at the notch.

One method to improve uniformity near the notch is to remove ring contact fingers at the notch. This is effective when the plated film is thin (<0.5 microns). For films greater than 0.5 microns thick, the notch region still plates preferentially when the fingers near the notch are removed.

Because the wafer is rotating during plating, special shielding or geometry modifications to components of plating apparatus that do not rotate with the wafer are challenging.

The engineering challenges presented by the notch (or other edge irregularities) may be met with a seal having a flatted section at the notch. The shape of the seal at the notch is changed, relative to the rest of the seal, to reduce current crowding at the notch. The change in the seal shape changes the resistance or restriction of a current thief electrode current between a current thief electrode and the wafer edge. Current thief electrode current is preferentially focused at the current crowding area near the notch and the film thickness uniformity is improved.

As an alternative or supplemental design feature for improving uniformity at the notch, a separate contact channel for the contact fingers in the flat region may be used. This channel can be driven to a slightly higher potential so that the plated film at the notch is more uniform with the rest of the wafer. In addition, a small external current thief electrode may be imbedded in the external body of the seal near the flat. This external current thief electrode may be controlled to the same potential as the rest of the ring and not require a separate power supply channel. The thieving region reduces the current crowding at the flat. The external current thief electrode may be deplated during each ring maintenance step.

The techniques described above may be used for copper damascene plating with a sealed contact ring having a flat at the notch. They may also be used for electroplating wafers in a wafer level packaging (WLP) process, if the electroplating apparatus has an edge current thief electrode. In these applications, the seal shape at portions of the wafer circumference may be changed to allow more or less thieving in edge regions like the notch which would otherwise not plate uniformly. For example, while wafers undergoing a WLP process may not need a seal with a flat side because they have no notch, they may have regions of less open area (i.e. more photoresist coverage) around the edge of the wafer that results in current crowding and reduced plating uniformity.

Many wafers used in a WLP process have a scribe region near the notch characterized by less open area. In processing these types of wafers, a seal with a smaller cross section at the notch allows the current thief electrode to act preferentially at the scribe region, improving current flux uniformity. Where partial die are not patterned on the wafer (i.e. no dummy bumps), there may be varying regions of continuous photoresist around the wafer which can also be matched with an appropriate varying ring cross section to cause the current thief electrode to act more or less strongly.

Figure 1:
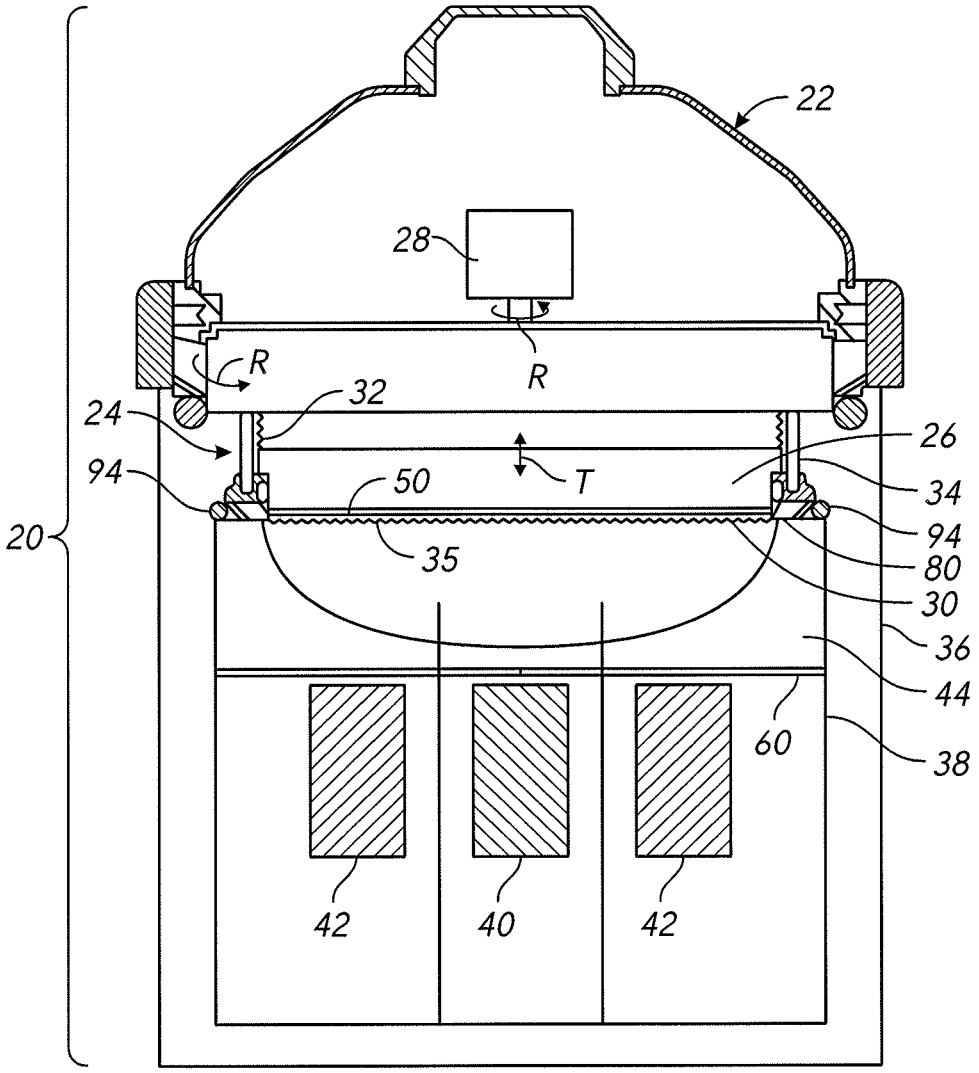
FIG. 1 PRIOR ART
FIG. 1 is a schematic drawing of an electroplating apparatus.

Turning now in detail to the drawing, as shown in FIG. 1, an electroplating apparatus 20 has a rotor 24 in a head 22 for holding a wafer. The rotor 24 includes a backing plate 26 and a contact ring 30 having a seal 80. Contact ring actuators 34 move the contact ring 30 vertically (in the direction T in FIG. 1), to engage the contact ring 30 and the seal 80 onto the down facing surface of a wafer or substrate 50. A bellows 32 may be used to seal internal components of the head.

The contact ring typically has a plurality of perimeter contact fingers 35 that contact a conductive layer on the wafer 50. The perimeter contact fingers are evenly spaced apart around the perimeter of the contact ring. A contact ring for plating a 300 mm diameter wafer may have e.g., 360 or 720 perimeter contact fingers 35. The head 22 is positioned to place the wafer 50 into a bath of liquid electrolyte held in a vessel 38 in a base 36. One or more anodes are in contact with the liquid electrolyte. FIG. 1 shows a design having a center anode 40 surrounded by a single outer anode 42, although multiple concentric outer anodes may be used. An electric field shaping unit 44 made of a di-electric material may be positioned in the vessel between the electrodes and the wafer.

A membrane 60 may optionally be included, with anolyte in a lower chamber below the membrane and with catholyte in an upper chamber above the membrane 60. Electric current passes from the electrodes through the electrolyte to a conductive surface on the wafer. A motor 28 in the head may be used to rotate the wafer during electroplating.

Figure 2:
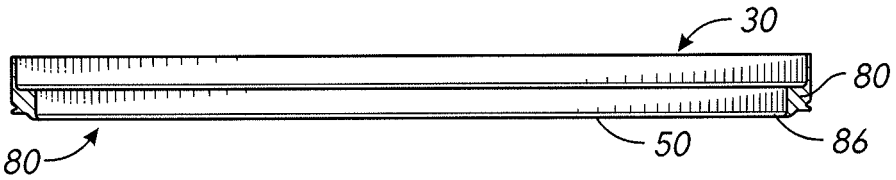
FIG. 2 PRIOR ART
FIG. 2 is a schematic drawing of the contact ring of the electroplating apparatus shown in FIG. 1.
Figure 3:
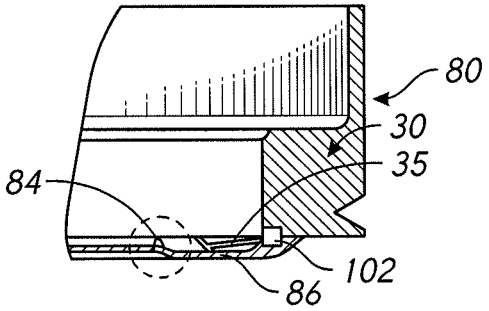
FIG. 3 PRIOR ART
FIG. 3 is an enlarged detail view of a section of the seal on the contact ring shown in FIG. 2.
Figure 4:
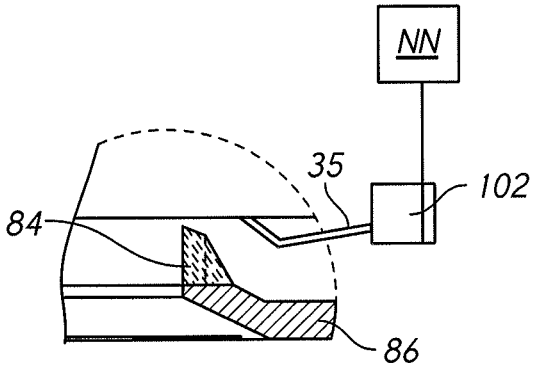
FIG. 4 PRIOR ART
FIG. 4 is a further enlarged detail view of tip of the seal of FIG. 3.

Turning to FIGS. 2-4, the seal 80 typically has an elastomer tip 84 which contacts and forms a seal against the wafer, with the elastomer tip 84 supported on, or part of, a rim 86 having a beam-like or cantilever structure. The perimeter contact fingers 35, which are typically flexible metal elements, touch the wafer radially outward of the seal, so that they are not exposed to the electrolyte. The seal 80 generally has a uniform cross section around the entire circumference.

Figure 6:
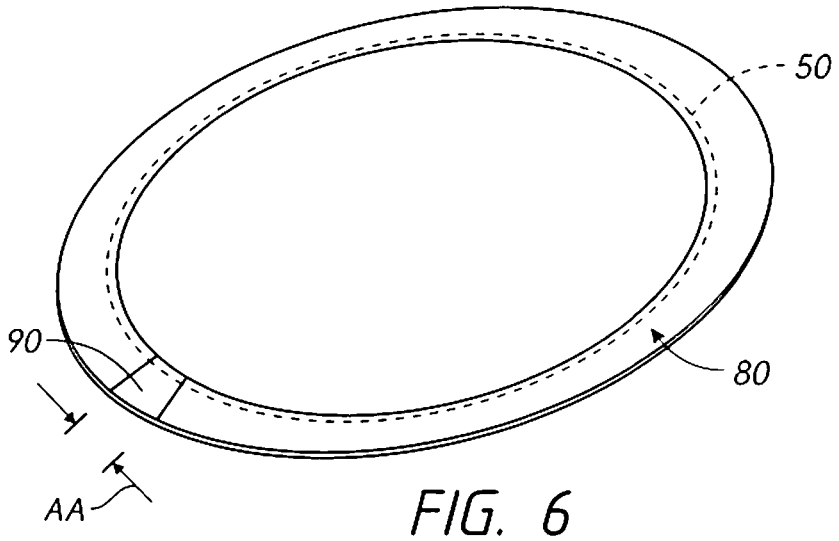
FIG. 6 is a perspective schematic view of the seal as shown in FIG. 2.

Referring now to FIG. 6, to compensate for current crowding at the notch 52, the present apparatus 20 may have a seal 80 having a thin section 90. In use, the wafer 50 is loaded into the apparatus 20 with the notch 52 aligned with the thin section 90. As the seal 80 rotates with the wafer 50 during processing, the thin section 90 remains aligned with the notch 52. For a 300 mm diameter wafer having an industry standard notch, the flat section may have a width AA of 25-33 mm, or 27-31 mm.

Figure 7:
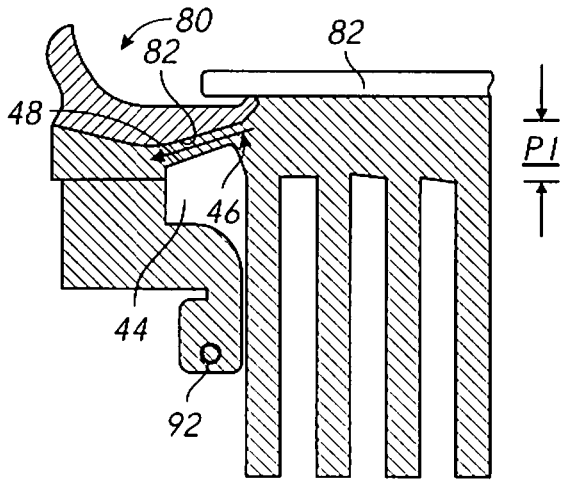
FIG. 7 is a schematic view of all sections of the seal in a processing position, except at the notch shown in FIG. 5.

In FIGS. 7-9B, the gray areas represent liquid electrolyte 46 in the vessel 38. The white areas represent the solid material of the field shaping unit 44. FIG. 7 shows a cross section of seal 80 around the entire circumference, except at the thin section 90. An electric current flow path through the electrolyte 46 with characteristic dimension P1 is formed between the bottom or down-facing surface 82 of the seal 80 and the top surface 48 of the field shaping unit 44.

Figure 8:
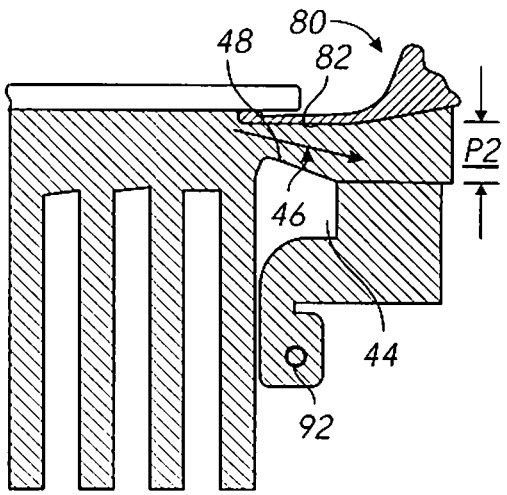
FIG. 8 is a schematic section view of the seal of FIGS. 6 and 7, at the notch.

FIG. 8 shows a cross section of the seal 80 at the thin section 90. At the thin section 90, the seal 80 does not project down as far as it does over the rest of the circumference of the seal 80. As a result, the electric current flow path through the electrolyte 46 at the thin section 90 has a characteristic dimension P2, which is 20-400% or 50-200% greater than P1. As the resistance of the P2 path is less than the P1, the first electrode 92 acting as a current thief exerts a stronger influence on the electric field at the notch 52, helping to compensate for the current crowding at the notch 52.

Figure 9A:
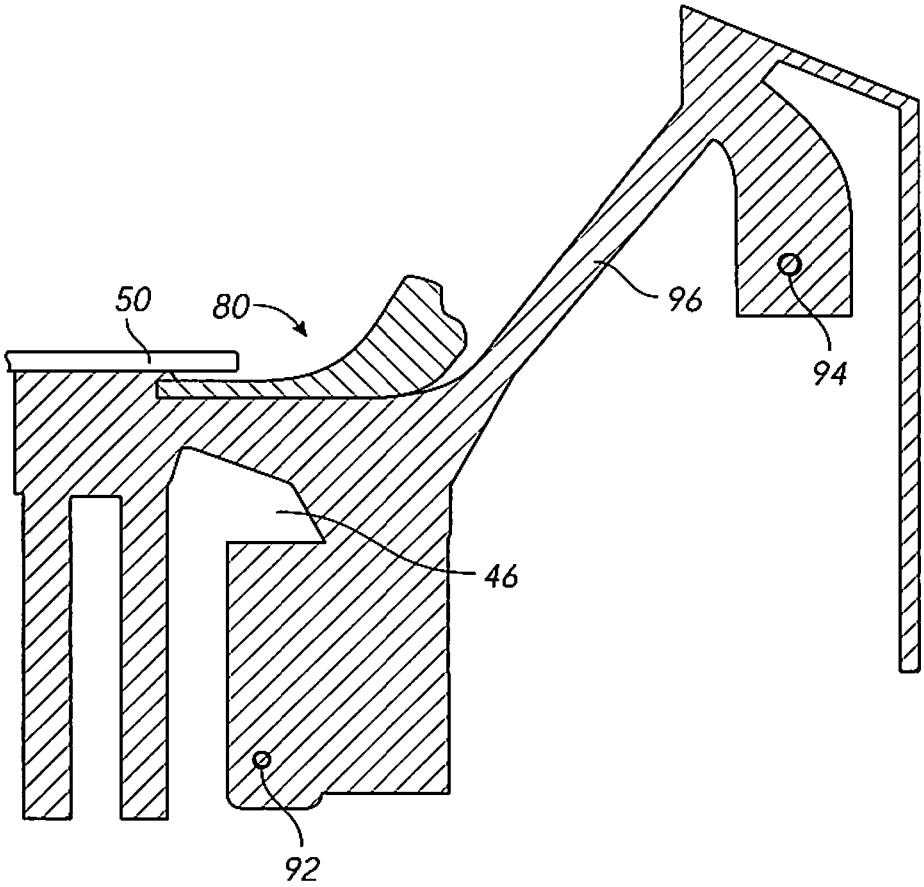
FIG. 9A is a schematic section view of an alternative embodiment.

FIG. 9A shows an alternative design having an outer current flow path 96 leading to a second or outer electrode 94. Both electrodes 92 and 94 may be connected to current thief channels drawing thieving current, or the second electrode 94 may act as a current thief while the first electrode 92 acts an anode (with the contact fingers acting as a cathode). With the first electrode 92 acting as an additional anode and second electrode 94 acting as a current thief, the outer current flow path is increased, allowing for better compensation for wafer offset and notch correction. The cross section area and length of the outer current flow path or space 96 (which is a volume of electrolyte) influences the amount of current drawn from the wafer edge to the second electrode 94. The cross section area of the outer current flow path 96 may be increased around the notch by providing a local recess in the contact ring (which rotates with the wafer so that the recess remains aligned with the notch during plating). The outer current flow path 96 may be increased adjacent to regions of greater photoresist coverage near the edge of the wafer in wafer level packaging processes.

Figure 9B:
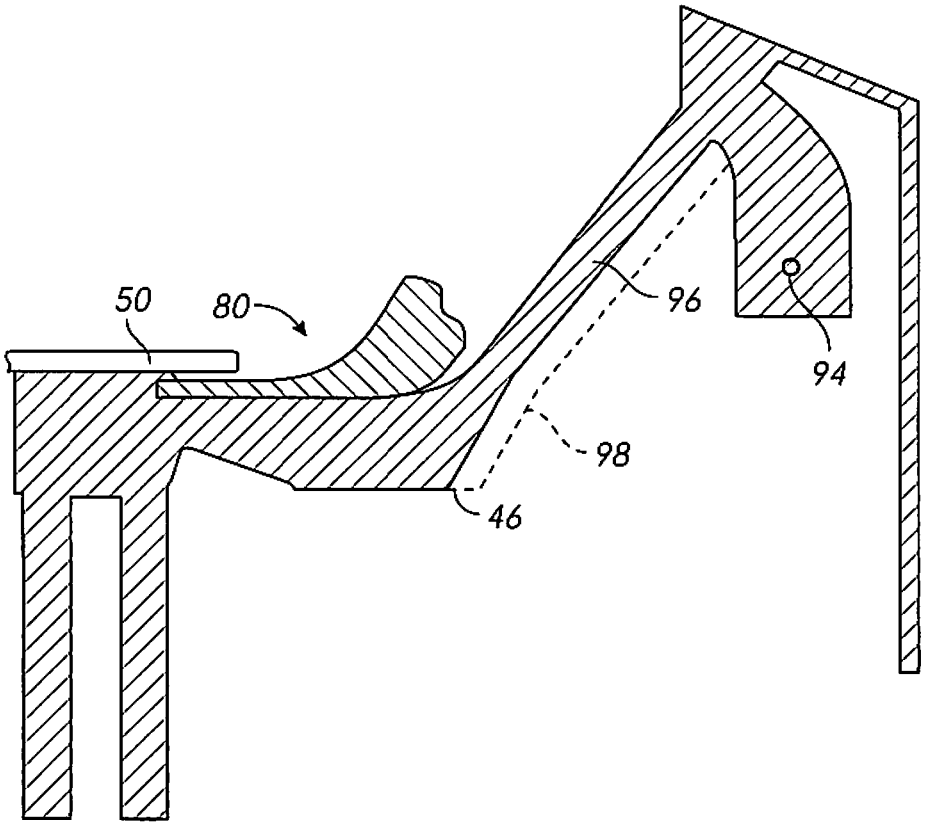
FIG. 9B is a schematic section view of another alternative embodiment.

FIG. 9B shows a modified design having a second electrode 94 configured as a current thief electrode. The embodiment in FIG. 9B is similar to design shown in FIGS. 7-8 with just one thief electrode, but in FIG. 9B the thief electrode is moved radially outward to allow for a longer length for the outer current flow path 96 for more control of the relative resistance to the outer current flow path 96 around the circumference of the wafer. The thief current for the electrode 94 may be current controlled by a power supply. Alternatively, the second electrode 94 may be coupled to the wafer via the electrolyte in the outer current flow path 96 and may use resistors to split the cathode current (for example with the outer current thief electrode current about 15-25% of the wafer current).

Also as shown in FIG. 9B, in a processing system where the wafer does not rotate during plating, a recess 98 may be provided in the vessel wall. During plating, with the notch aligned with the recess 98, a wider flow path through the electrolyte is provided from the region of the notch to the second electrode 94 acting as a current thief electrode. The recess 98 increases the influence of the current thief at the region of the notch, to reduce or avoid current crowding at the notch. The vessel having a recess 98 which is useful for reducing current crowding at a notch or scribe region when not rotating the wafer can also be used to uniformly plate a wafer without a notch or photoresist scribe region by simply rotating the wafer. Since the effect of the altered electric field due to recess 98 is relatively small, it has almost no effect when averaged out around the circumference of a rotating wafer.

Figure 10:
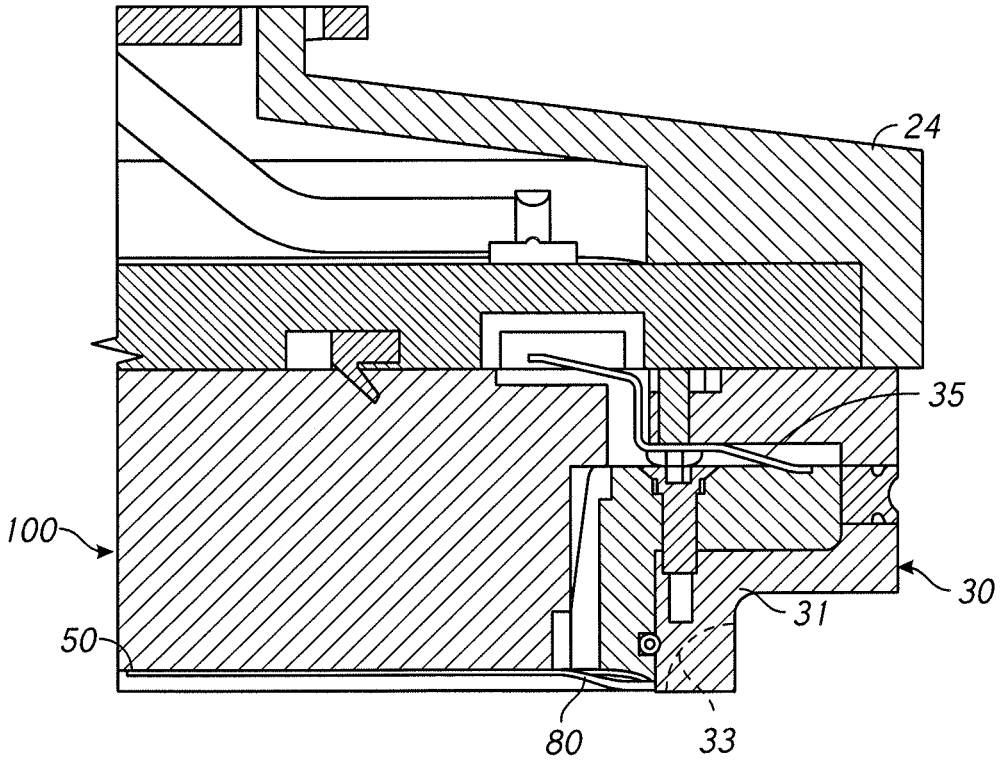
FIG. 10 is an enlarged detail section view of the electrical connection between the contact fingers on the ring contact to the chuck assembly and the rotor.

Turning now to FIG. 10, in certain wafer processing systems, the wafer is placed into a chuck 100 which includes a contact ring 30 with the seal 80. The chuck (with the wafer enclosed) travels through a processing system having an array of various apparatus or chambers to perform different processing steps. In this type of system, seals modified as discussed above may be matched to specific types of wafers. For example, the seal on one set of chucks for wafers may have reduced thickness regions near the scribe, and other chucks may have seals specially modified for use with wafers having dummy bumps. With this approach, no changes to the electroplating apparatus itself are needed to handle various wafers and their unique plating uniformity issues around the wafer circumference.

Referring to FIGS. 9B and 10, the contact ring 30 typically includes an insulator ring 31 made of plastic or other dielectric material. A recess 33 shown in dotted lines may be provided in the ring 31 in the area of notch, allowing additional current thief electrode current to flow near the notch and better compensate for the effect of the notch on the electric field, with the elastomer seal having a uniform shape and size around the entire contact ring, including at the notch.

The rectangular-shaped photo-resist area covering the notch causes a high local current density along the edges of the photo-resist covered area. Mathematical modeling shows current crowding along all of the edges of the rectangular-shaped area. The inward and circumferential extent of affected area is comparable to the size of the covered area. Modeling also suggests that local current crowding near the photo-resist covered notch area is not significantly mitigated by removing the electrical contacts near the notch. On the other hand, local current crowding near the notch area is significantly reduced by electrically biasing the metal seed layer, i.e., by forcing current (a positive charge) into the outer edge of the notch area, and/or applying a positive voltage bias along the outer edge of the notch area.

Since the current crowding effect extends over an area larger than the extra photo-resist covered area, the compensating edge electrical bias should also extend beyond the outer edge of the photo-resist covered notch area. The positive voltage is applied locally at the notch, so that it has little or no effect on plating of areas of the wafer away from the notch. No synchronization of the wafer rotation to a local shield is needed, which significantly simplifies controlling the plating process. In addition, current thief electrodes are not required. The positive voltage may be highly effective as well because it is applied at the notch which is the source of the geometric asymmetry, in contrast to using a shield that is necessarily located some distance away from the notch.

Of course, this local voltage approach may also be used to compensate for other wafer-pattern induced sources of circumferential non-uniformity, apart from excess photoresist at the notch, although different wafer patterns that induce a circumferential non-uniformity may require a custom electrical-bias scheme. This local voltage approach may also enable recipe control versus hardware control of pattern-induced non-uniformities.

In existing known plating apparatus, as shown in FIG. 3, there is a single conductive perimeter voltage ring 102 supplied with a negative voltage (relative to the anodes 40 and 42) from a negative voltage source NN shown in FIG. 4. The perimeter contact fingers 35 extending radially inwardly from the perimeter voltage ring 102 are evenly spaced apart around the entire perimeter of the contact ring 30, and are all at the negative voltage of the perimeter voltage ring 102.

Figure 11:
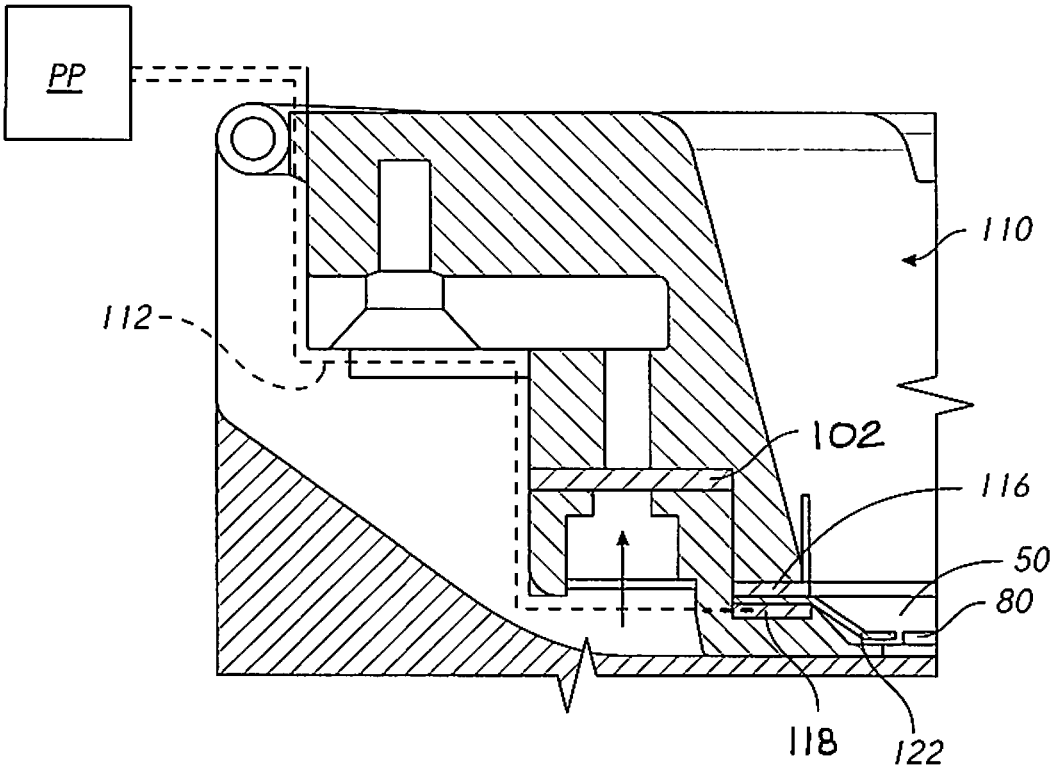
FIG. 11 is a schematic section view of a contact ring having a normal voltage segment and a notch segment at the notch position having a positive voltage.
Figure 12:
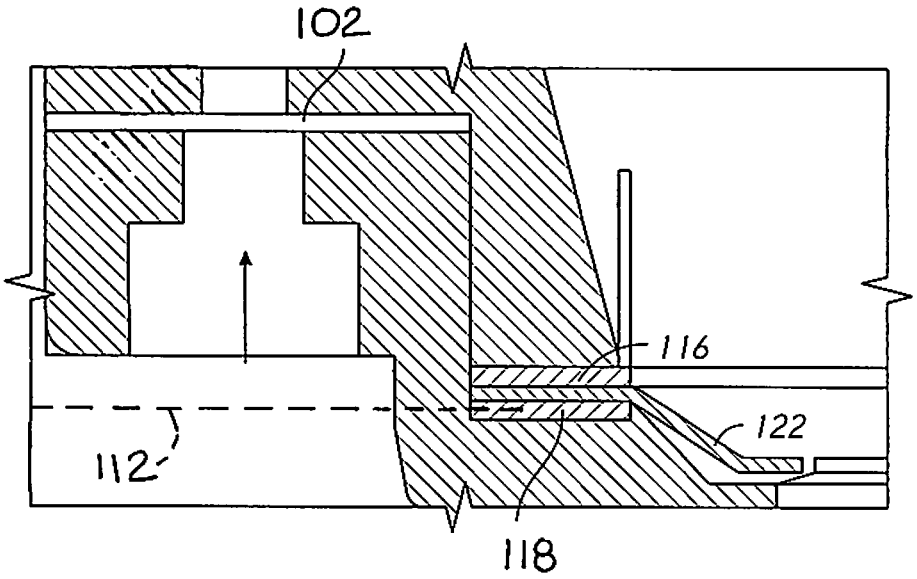
FIG. 12 is an enlarged detail view of the notch segment shown in FIG. 11.

Turning to FIGS. 11-12, the local positive voltage approach described above may be implemented by modifying an electroplating apparatus as shown in FIG. 3 to include a separate, independently-controlled positive electrical channel in the sealed contact ring 30. As shown in FIG. 11, a modified contact ring 110 may have a sector or segment of the perimeter voltage ring 102 (which supplies current to the perimeter contact fingers) removed and replaced with a notch contact segment 118, which is provided with a positive voltage and is insulated from the perimeter voltage ring 102 by an insulator segment 116. A notch channel lead 112, such as a polyimide coated ribbon wire, is electrically connected to the notch contact segment 118, to apply a positive voltage from a positive voltage source PP to the notch contact segment 118, relative to voltage applied to the perimeter voltage ring 102.

Notch contact fingers 122 extend from the notch contact segment 118 to the wafer surface at the notch, providing the relatively positive voltage to the notch area. The notch contact fingers 122 may be mechanically the same as the perimeter contact fingers 35 on the perimeter voltage ring 102, although the notch contact fingers 122 are supplied with a positive voltage. The local insulator segment 116 may have a conductive section at the notch contact segment to provide electrical connections to the notch contact fingers 122, and an insulator section around the rest of the perimeter voltage ring 102, to electrically insulate the notch contact fingers 122 at the notch from the perimeter contact fingers 35 contacting the rest of the wafer.

Generally, the notch contact fingers 122 may have a much larger spacing relative to the perimeter contact fingers 35. In some cases even only one or two notch contact fingers 122 may be used, with over 300 perimeter contact fingers 35 on the modified contact ring 110. Correspondingly, the notch contact segment may subtend an arc of only 2-5 degrees of the diameter of the modified contact ring, with the perimeter voltage ring 102 subtending the remaining 355 to 358 degrees. For clarity of description, the perimeter voltage ring 102 is referred to as a ring, although it is not a complete 360 degree ring.

A method for electroplating a wafer using the local relatively positively voltage at the notch includes placing a wafer having a notch into a bath of electrolyte held in a vessel, with at least one notch contact finger placed onto the wafer at the notch and touching the wafer at the notch. The plurality of perimeter contact fingers contact the wafer around the entire perimeter of the wafer, except at the notch. The perimeter contact fingers are insulated from the notch contact fingers. The notch contact finger and the perimeter contact fingers are sealed from the electrolyte. Positive electrical current is introduced into the electrolyte from at least one anode in the vessel. Negative voltage is applied to the perimeter contact fingers from the negative voltage source NN shown in FIG. 4, while positive voltage is applied to the notch contact fingers from a positive voltage source PP shown in FIG. 11. If a current thief electrode is used, a second negative voltage is applied to the current thief electrode, with the second negative voltage typically different from the negative voltage applied to the perimeter contact fingers.

Figure 13:
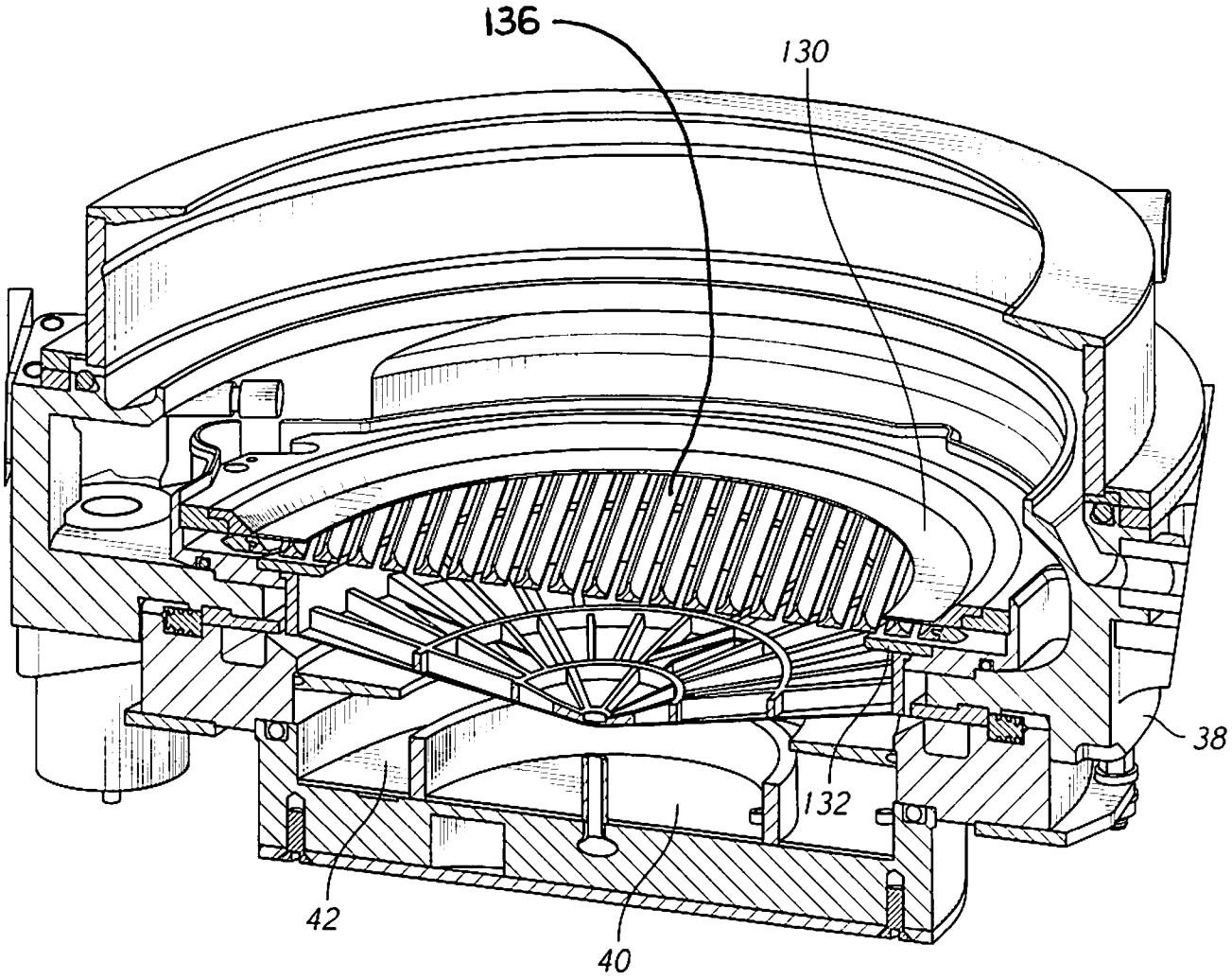
FIG. 13 is a perspective section view of a vessel having a modified weir shield and a chamber shield.
Figure 14:
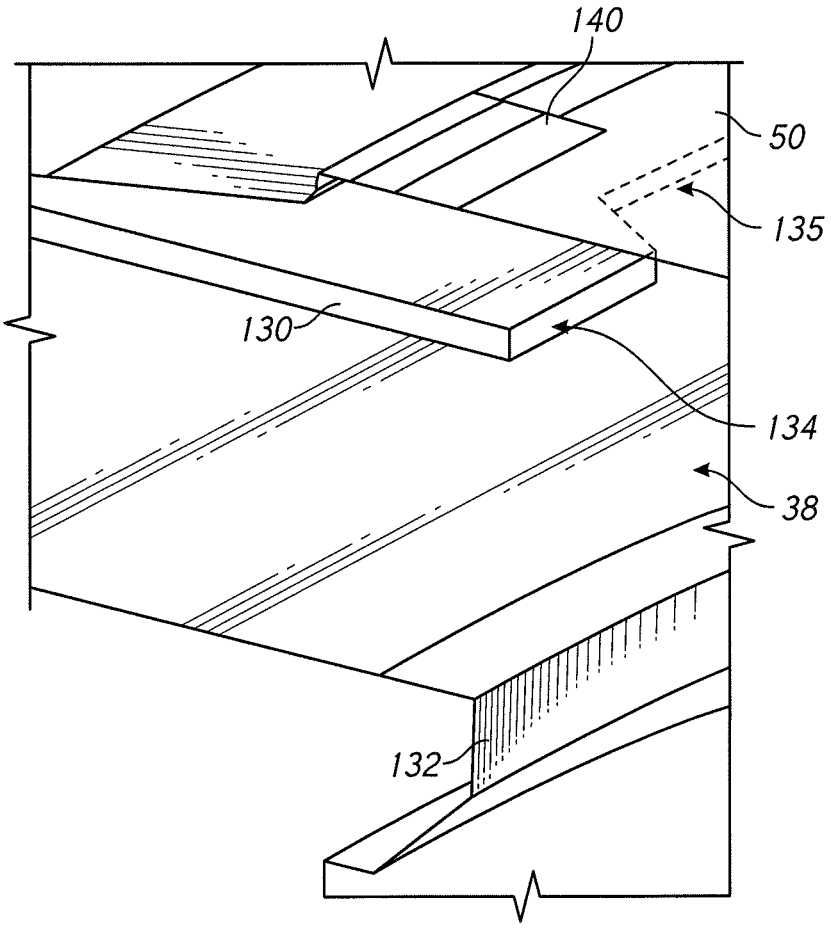
FIG. 14 is schematic perspective view of a projection on the weir shield shown in FIG. 13.
Figure 15:
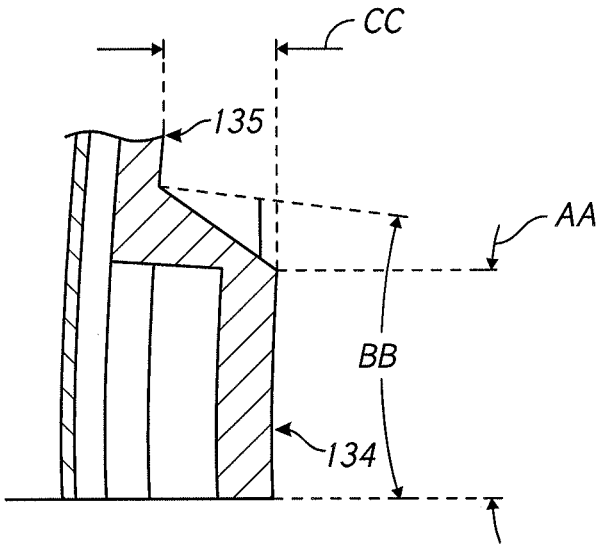
FIG. 15 is a diagram of the projection shown in FIG. 14.

In an alternative design, as shown in FIGS. 13-15, the processor has a vessel 38 including a weir shield 130, which is a dielectric annular shield positioned close to the wafer and above an alternating paddle or agitator 136. A chamber shield 132 is a similar dielectric annular shield positioned just below the paddle 136. The weir shield is modified to include an inward projection 134 at the notch. The weir shield 130 has a circular inner perimeter 135. The inward projection 134 is generally integral with the rest of the weir shield, with both comprising a dielectric material. The projection 134 on the weir shield 130 extends inwardly from the circular inner perimeter 135 by dimension CC, typically about 4-7 mm. The notch area 140 of the wafer (which is typically essentially square or rectangular) has only photo-resist and no metal plating, is typically about 4-5 mm wide. The projection 134 extends over an angular sector AA of 2-5 degrees, and 3 degrees in the example shown. The transitions at either end of the projection 134 extend over an angular sector BB of 1-3 degrees greater than angular sector AA, for a 300 mm wafer.

The projection 134 shields the notch area from the anodes, reducing the electric field at the notch area and pushing current away from the notch, to reduce electrical current crowding around the notch. The weir shield 130 may be within 1-3 mm of the surface of the notch area, so that the modified weir shield provides a simple yet highly effective technique for compensating for non-uniform wafers. Of course, in this design, the projection 134 must remain aligned with the notch, to provide more uniform plating at the notch for wafers having extra photo-resist at the notch. Hence, this design may be used for plating a wafer having extra photo-resist at the notch, with wafer not rotating.

In plating chambers having an agitator or a paddle, the paddle may be designed without any raised ribs that might interfere with the weir shield modifications for the notch area. It is also possible to place one or more local shields on the agitator, in a plating apparatus that also rotates the wafer, and with the movement of the agitator synchronized with the rotation of the wafer, so that the shield is aligned under the notch on the wafer for sufficient intervals to provide effective shielding of the notch. In this design, wafers may also be plated without rotation, with the agitator movement similarly positioning a local shield on the agitator under the notch for sufficient intervals to provide effective shielding of the notch.

A plating chamber or apparatus having the weir shield modification shown in FIGS. 13-15 may also be used for plating wafers that do not have extra photo-resist at the notch. In this case, the wafer is rotated normally. The averaging effect due to wafer rotation minimizes the effect of the local modification to the weir shield, so that plating quality is not substantially affected.

As used here, wafer means a substrate, for example a silicon wafer, on which microelectronic, micro-mechanical and/or micro-optical devices are formed. The techniques described above may similarly be used to reduce plating deviations caused by scribe regions. The terms positive voltage and negative voltage as used here mean relative voltage, and not absolute voltage. References to the notch relative to a portion or area of the wafer mean the region RR of the notch as shown in FIG. 5, with RR a half circle centered around the notch 52 and having a radius of 3-8 or 4-6 millimeters.

Thus, novel apparatus and methods have been shown and described. Various changes and substitutions may of course be made, without departing from the spirit and scope of the invention. The invention, therefore, should not be limited except by the following claims and their equivalents.

The invention claimed is:

1. Electroplating apparatus, comprising:

a vessel for holding electrolyte;

at least one first electrode in the vessel;

a field shaping unit in the vessel;

a head including a contact ring for holding a wafer having a pattern-induced non-uniformity, the contact ring having a seal including a first section and a second section having a reduced thickness less than the first section, with the head movable to a processing position wherein the seal is adjacent to the field shaping unit; and a current thief electrode in electrical contact with the electrolyte in the vessel, the reduced thickness of the second section of the seal increasing flow of electric current to the current thief electrode adjacent to the pattern-induced non-uniformity.

2. The apparatus of claim 1 with the current thief electrode below the seal when the head is in the processing position.

3. The apparatus of claim 1 with the current thief electrode above the seal, and spaced radially to the outside of the seal, when the head is in the processing position.

4. The apparatus of claim 1 wherein the first section has a thickness 50-200% greater than the second section.

5. The apparatus of claim 1 wherein with an electric field provided in electrolyte in the vessel, a first electric current flow path is formed between the first section of the seal and the field shaping unit having a first resistance, and a second current flow path is formed between the second section and the field shaping unit having a second resistance less than the first resistance so that the current thief electrode exerts a stronger influence on the electric field at the pattern-induced non-uniformity to compensate for current crowding at the pattern-induced non-uniformity.

6. The apparatus of claim 1 further including a recess in a wall of the vessel adjacent to the non-uniformity, the recess having a dimension proportional to the pattern-induced non-uniformity, the recess increasing flow of electric current to the current thief electrode adjacent to the pattern-induced non-uniformity.

7. The apparatus of claim 1 with the pattern-induced non-uniformity contact segment subtending an arc of 2-5 degrees.

8. The apparatus of claim 1 further including a weir shield in the vessel between the first electrode and the wafer, with the wafer at a fixed angular orientation to the weir shield while the wafer is in a processing position; and a projection on the weir shield aligned under the pattern-induced non-uniformity on the wafer, to reduce electrical current crowding around the pattern-induced non-uniformity.

9. The apparatus of claim 8 with the weir shield having a circular inner perimeter and with the projection extending radially inwardly 4-7 millimeters from the circular inner perimeter.

10. The apparatus of claim 8 with the projection subtending an arc of 3 to 6 degrees.

11. The apparatus of claim 8 with the weir shield including the projection spaced apart from the wafer by 1-3 millimeters.

12. The apparatus of claim 10 with the projection integral with the weir shield and with the weir shield comprising a di-electric material.

13. Electroplating apparatus, comprising:

a vessel for holding electrolyte;

at least one first electrode in the vessel;

a field shaping unit in the vessel;

a head including a contact ring for holding a wafer having a pattern-induced non-uniformity;

at least one second electrode in electrical contact with electrolyte the vessel;

the contact ring including a perimeter voltage ring having a plurality of perimeter contact fingers for contacting the wafer around the perimeter of the wafer, and a pattern-induced non-uniformity contact segment having one or more pattern-induced non-uniformity contact fingers for contacting the wafer at the pattern-induced non-uniformity, and with the perimeter voltage ring insulated from the pattern-induced non-uniformity contact segment;

the perimeter voltage ring electrically connected only to a first voltage source; and the pattern-induced non-uniformity contact segment electrically connected to only a second voltage source.

14. Electroplating apparatus, comprising:

a vessel for holding electrolyte;

at least one first electrode in the vessel;

a field shaping unit in the vessel;

a head including a contact ring for holding a wafer having a pattern-induced non-uniformity, with the head movable to a processing position wherein a seal is adjacent to the field shaping unit;

a current thief electrode in electrical contact with the electrolyte in the vessel;

the vessel having a wall including a recess at the non-uniformity, with a dimension proportional to the pattern-induced non-uniformity, to reduce current crowding at the pattern-induced non-uniformity.

15. The apparatus of claim 1 further comprising a second current thief electrode spaced apart from the current thief electrode vertically in the vessel, with the current thief electrode causing an electrical thief current flow above the seal and the second current thief electrode causing an electrical second thief current flow below the seal.

16. The apparatus of claim 1 further comprising a second electrode spaced apart from the current thief electrode, with the current thief electrode causing an electrical thief current flow above the seal and the second electrode acting as a second anode or as a second current thief electrode.

17. The apparatus of claim 14 further comprising a second electrode spaced apart from the current thief electrode, with the current thief electrode causing an electrical thief current flow above the seal and the second electrode acting as a second anode or as a second current thief electrode.

18. The apparatus of claim 17 with the current thief electrode at a first side of the recess and the second electrode at a second side of the recess.

* * * * *